US011473338B2

(12) United States Patent
Lai

(10) Patent No.: US 11,473,338 B2
(45) Date of Patent: Oct. 18, 2022

(54) SHARED STORAGE CABINET AND LOCK THEREOF

(71) Applicant: XIAMEN MAKE SECURITY TECHNOLOGY CO., LTD., Fujian (CN)

(72) Inventor: Hongliang Lai, Xiamen (CN)

(73) Assignee: XIAMEN MAKE SECURITY TECHNOLOGY CO., LTD., Fujian (CN)

( * ) Notice: Subject to any disclaimer, the term of this patent is extended or adjusted under 35 U.S.C. 154(b) by 145 days.

(21) Appl. No.: 16/957,381

(22) PCT Filed: Feb. 9, 2018

(86) PCT No.: PCT/CN2018/075931
§ 371 (c)(1),
(2) Date: Jun. 24, 2020

(87) PCT Pub. No.: WO2019/153222
PCT Pub. Date: Aug. 15, 2019

(65) Prior Publication Data

US 2020/0332562 A1 Oct. 22, 2020

(51) Int. Cl.
*E05B 47/06* (2006.01)
*A47B 96/04* (2006.01)
(Continued)

(52) U.S. Cl.
CPC ..... *E05B 47/0607* (2013.01); *A47B 96/04* (2013.01); *E05B 9/02* (2013.01); *E05B 17/22* (2013.01)

(58) Field of Classification Search
CPC ..... A47B 96/04; A47B 63/00; A47B 88/50; A47B 2097/008; A47B 81/00;
(Continued)

(56) References Cited

U.S. PATENT DOCUMENTS 4,978,153 A * 12/1990 Hirsch ..... E05B 47/0002 292/216
7,828,399 B1 * 11/2010 Bass ..... A47B 61/00 312/109
(Continued)

FOREIGN PATENT DOCUMENTS

CN 202296065 U * 7/2012 ..... E05B 47/0009
EP 2808469 A1 * 12/2014 ..... E05B 65/463
(Continued)

*Primary Examiner* — Kristina R Fulton
*Assistant Examiner* — Tal Saif
(74) *Attorney, Agent, or Firm* — Leong C. Lei

(57) ABSTRACT

A shared storage cabinet and a lock thereof are disclosed. The shared storage cabinet includes a cabinet body and a lock installed on the cabinet body. The cabinet body is divided into a plurality of cells by means of a frame thereof. The cabinet lock includes a lock body, a locking piece and a locking and unlocking assembly. The lock body is laterally inserted into and fixed within the frame of the cabinet body. The locking and unlocking assembly is disposed within the lock body. One end of the locking piece is pivotally connected to one side of the lock body, while the other end of the locking piece rotates about the end thereof to achieve locking/unlocking in cooperation with the locking and unlocking assembly of another adjacent cabinet lock on the frame.

8 Claims, 8 Drawing Sheets

(51) Int. Cl.
*E05B 9/02* (2006.01)
*E05B 17/22* (2006.01)

(58) Field of Classification Search
CPC ..... A47B 88/423; A47B 88/43; A47B 88/57; A47B 2210/0016; A47B 2210/0018; E05B 47/0607; E05B 9/02; E05B 17/22; E05B 47/0004; E05B 2047/0069; E05B 47/0047; E05B 65/025; E05B 65/46; E05B 65/5215; E05B 65/462; E05B 2047/0016; E05B 2047/0073; E05B 2047/0094; E05B 2047/0095; E05B 47/00; E05B 47/0002; E05B 47/0003; E05B 47/06; E05B 85/20; E05B 85/24; E05B 85/243; E05B 85/26; E05B 65/44; E05B 65/464; E05B 15/10; E05B 17/20; E05B 17/2007; E05B 17/2049; E05B 17/2053; E05B 17/2084; E05B 65/465; E05B 65/467; E05B 65/66; E05C 3/12; E05C 3/00; E05C 3/004; E05C 3/16; E05C 3/22; E05C 3/24; E05C 3/26; E05C 3/30; E05C 3/38; E05C 3/40; Y10T 292/0911; Y10T 292/0948; Y10T 292/1043; Y10T 292/1047; Y10T 292/1078; Y10T 292/1082; Y10T 292/696; Y10T 292/699; Y10T 292/702; G06F 1/184; G06F 1/185; G06F 1/186; E05G 1/06; E05G 1/08
USPC .... 312/217, 220, 215, 216, 222; 109/45, 53, 109/56–59 R; 70/78–86, 278.7, 279.1, 70/280–282; 361/759, 801, 803
See application file for complete search history.

(56) References Cited

U.S. PATENT DOCUMENTS

| | | | | |
|---|---|---|---|---|
| 2009/0235767 | A1* | 9/2009 | Garneau | E05B 65/46 292/201 |
| 2010/0308704 | A1* | 12/2010 | Rahilly | G07F 11/62 312/333 |
| 2015/0035294 | A1* | 2/2015 | Milligan | E05B 65/462 292/201 |

FOREIGN PATENT DOCUMENTS

| | | | | |
|---|---|---|---|---|
| FR | 2749343 | A1 * | 12/1997 | E05B 17/0037 |
| GB | 2478794 | A * | 9/2011 | A47B 88/40 |
| WO | WO-2004111370 | A1 * | 12/2004 | B65G 1/1371 |
| WO | WO-2010129303 | A2 * | 11/2010 | A47B 88/40 |
| WO | WO-2012075264 | A1 * | 6/2012 | A47B 88/20 |

* cited by examiner

SHARED STORAGE CABINET AND LOCK THEREOF

BACKGROUND OF THE INVENTION

1. Field of the Invention

The present invention relates to a storage cabinet, and more particularly to a shared storage cabinet and a lock thereof.

2. Description of the Prior Art

A conventional storage cabinet lock is generally installed partly on a cabinet body and partly on a cabinet door. The cabinet door and the cabinet body are locked through the two parts of the cabinet lock. However, for open storage cabinets without cabinet doors, there is no suitable lock to lock the objects in the cabinet. Moreover, the conventional lock is large in size and is not suitable for use in places where the installation space is limited and small. The conventional locks cannot be interlocked with each other.

For example, an open bookcase is divided into a plurality of cells by a frame thereof. The frame is very thin, so it is not easy to install the lock on the frame. In general, there is no separate lock for the bookcase to lock the books in the cells. In order to look up the bibliography and pick and place books easily, the bookcase does not have a unique lock to lock the books in the cabinet body. However, when storing expensive objects, it is necessary to use corresponding locks to ensure safety.

In view of this, the inventor of the present invention has devoted himself based on his many years of practical experiences to solve these problems and to develop a shared storage cabinet that can be unlocked through a mobile phone or smart device.

SUMMARY OF THE INVENTION

The primary object of the present invention is to provide a shared storage cabinet and a lock thereof, having a simple structure and small volume and being able to lock each storage cabinet by means of double locking and mutual locking.

In order to achieve the above object, the present invention adopts the following technical solutions:

A shared storage cabinet comprises a cabinet body and a cabinet lock installed on the cabinet body. The cabinet body is divided into a plurality of cells by a frame thereof.

The cabinet lock comprises a lock body, a locking piece, and a locking and unlocking assembly. The lock body is laterally inserted into and fixed in the frame of the cabinet body. The locking and unlocking assembly is disposed in the lock body. One end of the locking piece is pivotally connected to one side of the lock body. Another end of the locking piece is rotatable about the end thereof to achieve locking/unlocking in cooperation with the locking and unlocking assembly of another adjacent cabinet lock on the frame.

Furthermore, the lock body includes a mounting plate and a casing. The locking and unlocking assembly includes an electronic actuator, a first rotating member, a second rotating member, a first torsion spring, and a second torsion spring.

The mounting plate is laterally inserted into and fixed in the frame. The casing covers the mounting plate. An inner side of the casing is provided with a first shaft and a second shaft. The first rotating member is rotatably mounted on the casing through the first shaft. The first torsion spring is sleeved on the first shaft. One end of the first torsion spring is fixedly connected to the casing. Another end of the first torsion spring is fixedly connected to the first rotating member. The second rotating member is rotatably mounted on the casing through the second shaft. The second torsion spring is sleeved on the second shaft. One end of the second torsion spring is fixedly connected to the casing. Another end of the second torsion spring is fixedly connected to the second rotating member. The electronic actuator is movably mounted in the casing in an up-down manner and located below the first rotating member. An upper end of the electronic actuator is connected to a tail end of the first rotating member. A head end of the first rotating member is formed with a first hook. One end of the locking piece is pivotally connected to one side of the casing. The other end of the locking piece is formed with a second hook. A head end of the second rotating member is formed with a catching portion corresponding to the first hook and the second hook. The casing is formed with a notch corresponding to the second hook and disposed under the locking piece. The catching portion is located at the notch.

When locking, the locking piece is pushed by an external force to rotate about one end thereof, so that the second hook enters the notch of the casing of the another adjacent cabinet lock mounted on the frame. The second hook pushes the second rotating member of the another adjacent cabinet lock to rotate, and the second hook is engaged in the catching portion of the second rotating member to be positioned therein. The catching portion of the second rotating member pushes the first hook. The first hook slides into the catching portion through the first torsion spring to be positioned therein.

When unlocking, the electronic actuator is moved downward to pull the first rotating member to rotate about the first shaft, so that the catching portion is disengaged from the first hook, and the second rotating member is rotated by the second torsion spring to disengage the second hook of the locking piece from the catching portion.

Furthermore, the locking and unlocking assembly further includes an electronic switch. The electronic actuator and the electronic switch are connected to an external control device through wires or signal wires, respectively. The electronic switch is mounted on the casing corresponding to a tail end of the second rotating member. The tail end of the second rotating member is in contact with an elastic sheet of the electronic switch. When unlocked, the second rotating member is rotated by the second torsion spring, and its tail end pushes the elastic sheet to trigger the electronic switch.

Furthermore, the electronic actuator includes a seat and an electrically-driven sliding rod. The seat is fixed to the casing by screws. The seat has a groove therein. The electrically-driven sliding rod is slidably disposed in the groove in an up-down manner. An upper end of the electrically-driven sliding rod is connected to the tail end of the first rotating member through a connecting ring.

Furthermore, the casing is provided with a limiting block corresponding to the tail end of the first rotating member. The limiting block limits the first rotating member to a position where the first hook can slide into the catching portion. A first fixing post and a second fixing post are provided on the casing. One end of the first torsion spring and one end of the second torsion spring are fixedly connected the first fixing post and the second fixing post of the casing, respectively.

The first shaft and the second shaft are formed with internal screw holes. The mounting plate is formed with screw holes corresponding to the first shaft and the second shaft. Two fixing lugs are formed on upper and lower sides of the mounting plate, respectively. Amounting hole is formed in each of the fixing lugs.

Furthermore, the locking piece is formed with an accommodating hole. An induction coil is installed in the accommodating hole. A sealing sheet is attached to one side of the locking piece. The sealing sheet is configured to seal the induction coil in the accommodating hole.

Furthermore, the frame is formed with a receiving hole. The mounting plate is laterally inserted into the receiving hole and fixed in the frame.

A cabinet lock for a shared storage cabinet comprises a lock body, a locking piece, and a locking and unlocking assembly. The lock body is laterally inserted into and fixed in a frame of a cabinet body. The locking and unlocking assembly is disposed in the lock body. One end of the locking piece is pivotally connected to one side of the lock body. Another end of the locking piece is rotatable about the end thereof to achieve locking/unlocking in cooperation with the locking and unlocking assembly of another adjacent cabinet lock on the frame.

Furthermore, the lock body includes a mounting plate and a casing. The locking and unlocking assembly includes an electronic actuator, a first rotating member, a second rotating member, a first torsion spring, and a second torsion spring.

The mounting plate is laterally inserted into and fixed in the frame. The casing covers the mounting plate. An inner side of the casing is provided with a first shaft and a second shaft. The first rotating member is rotatably mounted on the casing through the first shaft. The first torsion spring is sleeved on the first shaft. One end of the first torsion spring is fixedly connected to the casing. Another end of the first torsion spring is fixedly connected to the first rotating member. The second rotating member is rotatably mounted on the casing through the second shaft. The second torsion spring is sleeved on the second shaft. One end of the second torsion spring is fixedly connected to the casing. Another end of the second torsion spring is fixedly connected to the second rotating member. The electronic actuator is movably mounted in the casing in an up-down manner and located below the first rotating member. An upper end of the electronic actuator is connected to a tail end of the first rotating member. A head end of the first rotating member is formed with a first hook. One end of the locking piece is pivotally connected to one side of the casing. The other end of the locking piece is formed with a second hook. Ahead end of the second rotating member is formed with a catching portion corresponding to the first hook and the second hook. The casing is formed with a notch corresponding to the second hook and disposed under the locking piece. The catching portion is located at the notch.

When locking, the locking piece is pushed by an external force to rotate about one end thereof, so that the second hook enters the notch of the casing of the another adjacent cabinet lock mounted on the frame. The second hook pushes the second rotating member of the another adjacent cabinet lock to rotate, and the second hook is engaged in the catching portion of the second rotating member to be positioned therein. The catching portion of the second rotating member pushes the first hook. The first hook slides into the catching portion through the first torsion spring to be positioned therein.

When unlocking, the electronic actuator is moved downward to pull the first rotating member to rotate about the first shaft, so that the catching portion is disengaged from the first hook, and the second rotating member is rotated by the second torsion spring to disengage the second hook of the locking piece from the catching portion.

Furthermore, the locking and unlocking assembly further includes an electronic switch. The electronic actuator and the electronic switch are connected to an external control device through wires or signal wires, respectively. The electronic switch is mounted on the casing corresponding to a tail end of the second rotating member. The tail end of the second rotating member is in contact with an elastic sheet of the electronic switch. When unlocked, the second rotating member is rotated by the second torsion spring, and its tail end pushes the elastic sheet to trigger the electronic switch.

After adopting the above solutions, the present invention has a simple structure and few components. When locking, the user pushes the locking piece to be rotated and locked to the locking and unlocking assembly of another adjacent cabinet lock. At this time, the locking piece spans two frames to lock the cell between the two frames, and the books or other objects in the cell cannot be taken out. The area of the locking piece can be adjusted according to the needs of the objects, so as to meet the safe storage of various objects. When unlocking, the locking piece is disengaged from another adjacent cabinet lock. Therefore, the present invention occupies a small space and is easy to operate, and the locking piece is equivalent to a "miniaturized door", which is convenient for immediate opening and closing.

Embodiments of the present invention will now be described, by way of example only, with reference to the accompanying drawings.

DETAILED DESCRIPTION OF THE PREFERRED EMBODIMENTS

Figure 9:
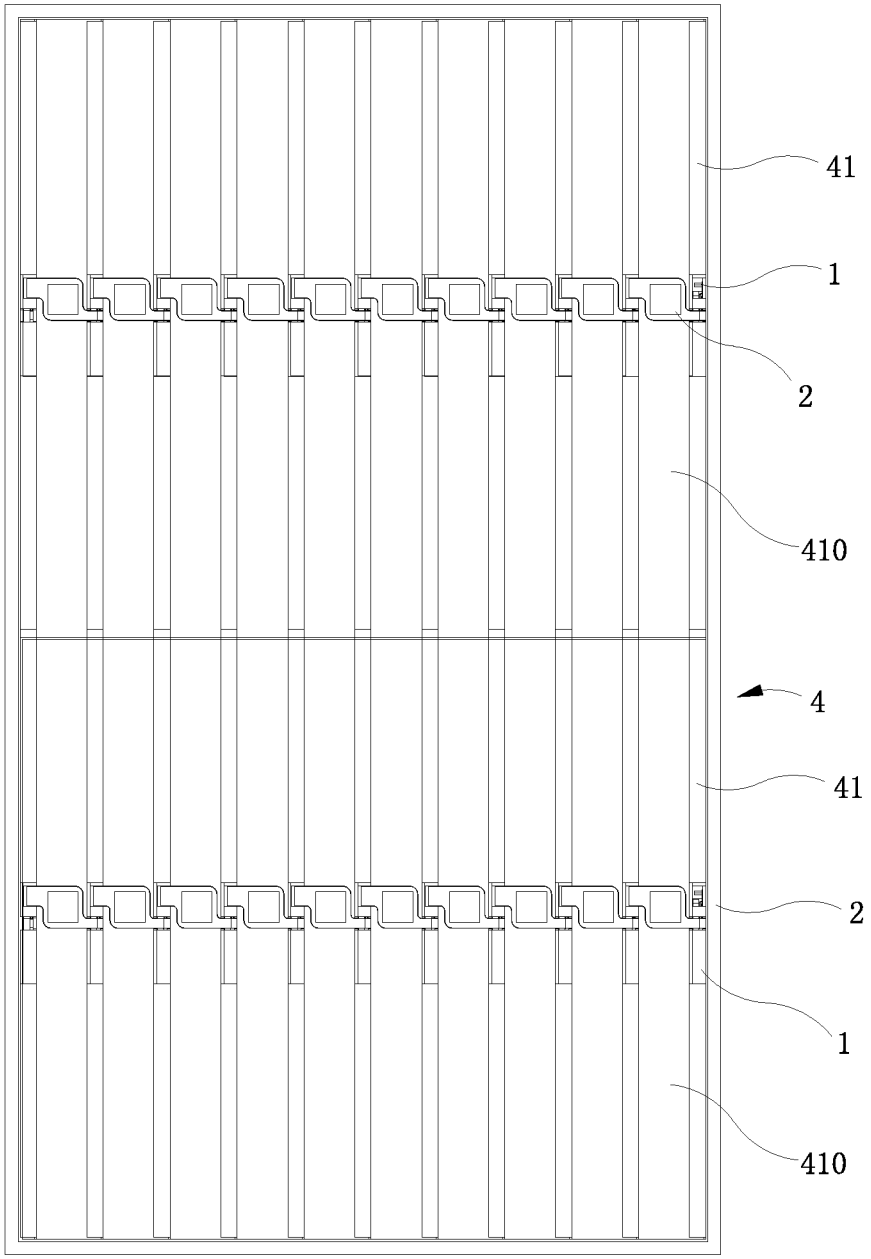
FIG. 9 is a front view of the present invention installed on a bookshelf.
Figure 10:
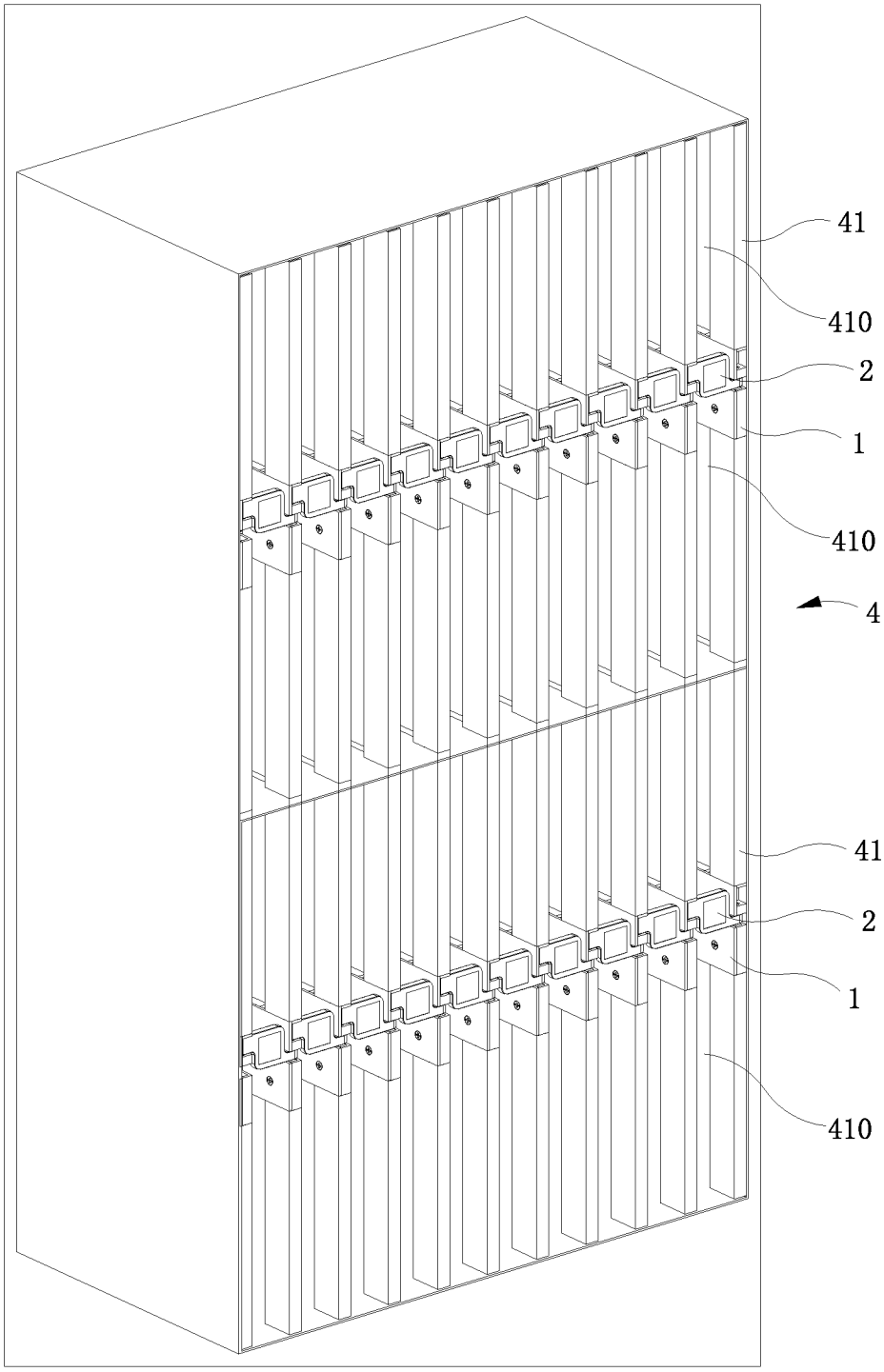
FIG. 10 is a perspective view of the present invention installed on the bookshelf.

As shown in FIGS. 1 to 8, the present invention discloses a shared storage cabinet, comprising a cabinet body 4 and a cabinet lock installed on the cabinet body 4. The cabinet body 4 is divided into a plurality of cells 410 by a frame 41 thereof (as shown in FIGS. 9 and 10). The cabinet lock comprises a lock body 1, a locking piece 2, and a locking and unlocking assembly 3.

The frame 41 is formed with a receiving hole 411. The lock body 1 includes a mounting plate 11 and a casing 12. The mounting plate 11 is laterally inserted into the receiving hole 411 and fixed in the frame 41. The casing 12 covers the mounting plate 11. An inner side of the casing 12 is provided with a first shaft 121 and a second shaft 122.

The locking and unlocking assembly 3 includes an electronic actuator 31, a first rotating member 32, a second rotating member 33, a first torsion spring 34, a second torsion spring 35, and an electronic switch 36. The first rotating member 32 is rotatably mounted on the casing 12 through the first shaft 121. The first torsion spring 34 is sleeved on the first shaft 121. The casing 12 is provided with a first fixing post 123 and a second fixing post 124. One end of the first torsion spring 34 is fixedly connected to the first fixing post 123 of the casing 12, and the other end of the first torsion spring 34 is fixedly connected to the first rotating member 32. The second rotating member 33 is rotatably mounted on the casing 12 through the second shaft 122. The second torsion spring 35 is sleeved on the second shaft 122. One end of the second torsion spring 35 is fixedly connected to the second fixing post 124 of the casing 12, and the other end of the second torsion spring 35 is fixedly connected to the second rotating member 33. The electronic actuator 31 is movably mounted in the casing 12 in an up-down manner and located below the first rotating member 32. Specifically, the electronic actuator 31 includes a seat 311 and an electrically-driven sliding rod 312. The seat 311 is fixed to the casing 12 by screws 5. The seat 311 has a groove 313 therein. The electrically-driven sliding rod 312 is slidably disposed in the groove 313 in an up-down manner. An upper end of the electrically-driven sliding rod 312 is connected to a tail end of the first rotating member 32 through a connecting ring 314. Ahead end of the first rotating member 32 is formed with a first hook 321.

One end of the locking piece 2 is pivotally connected to one side of the casing 12. The other end of the locking piece 2 is formed with a second hook 21. A head end of the second rotating member 33 is formed with a catching portion 331 corresponding to the first hook 321 and the second hook 21. The casing 12 is formed with a notch 125 corresponding to the second hook 21 and disposed under the locking piece 2. The catching portion 331 is located at the notch 125.

The electronic actuator 31 and the electronic switch 36 are connected to an external control device through wires/signal wires 6, respectively. The external control device is configured to give control signals and power to the electronic actuator 31 and the electronic switch 36. The electronic switch 36 is mounted on the casing 12 corresponding to a tail end of the second rotating member 33. The tail end of the second rotating member 33 is in contact with an elastic sheet 361 of the electronic switch 36. When unlocked, the second rotating member 33 is rotated by the second torsion spring 35, and its tail end pushes the elastic sheet 361 to trigger the electronic switch 36.

As shown in FIG. 9 and FIG. 10, when the cabinet lock of the present invention is to be installed, the lock body 1 is laterally installed into the frame 41. The frame 41 on either side of each cell 410 is provided with a cabinet lock. The locking piece 2 can be rotated about one end thereof, and the other end of the locking piece 2 can be rotated to another adjacent cabinet lock on the frame 41.

The locking process of the present invention is described below.

Figure 1:
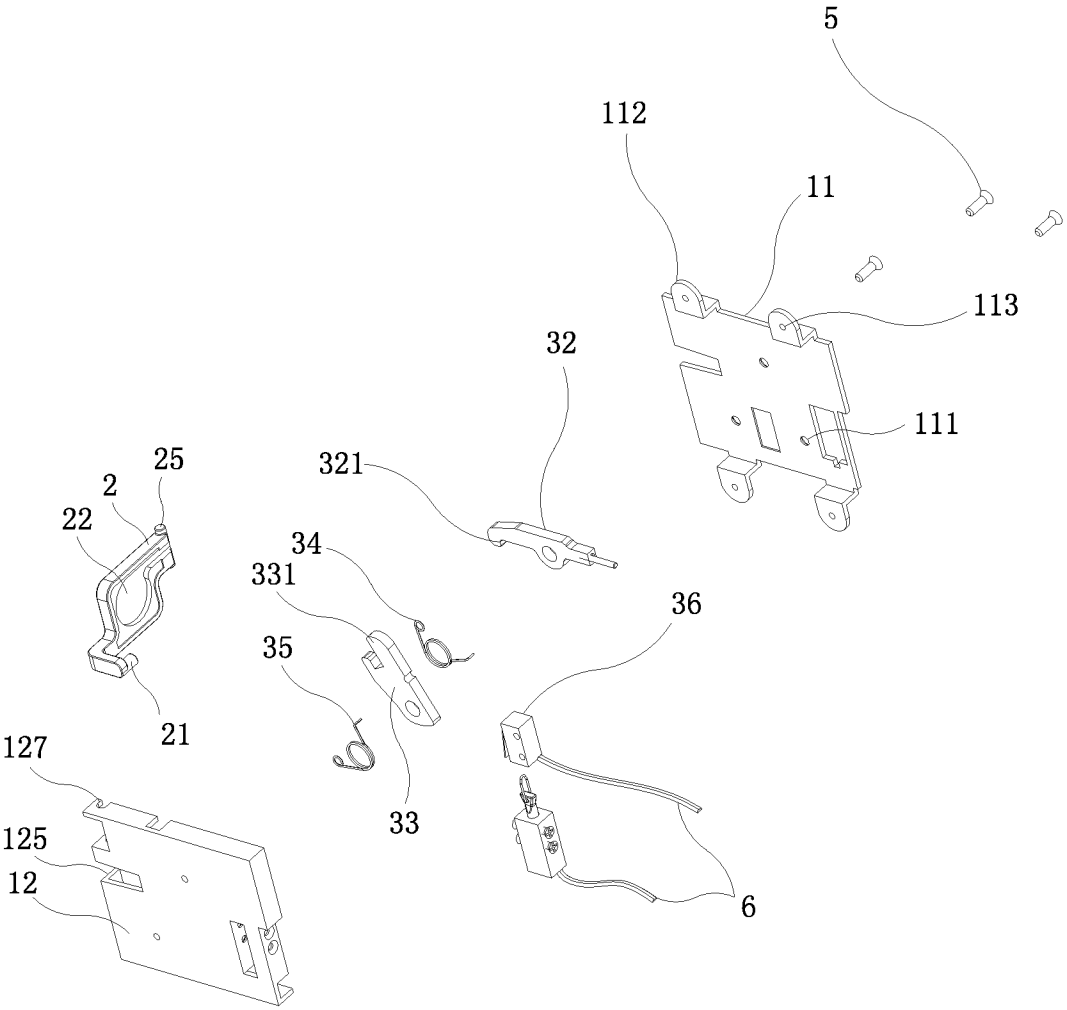
FIG. 1 is an exploded view of the present invention.
Figure 2:
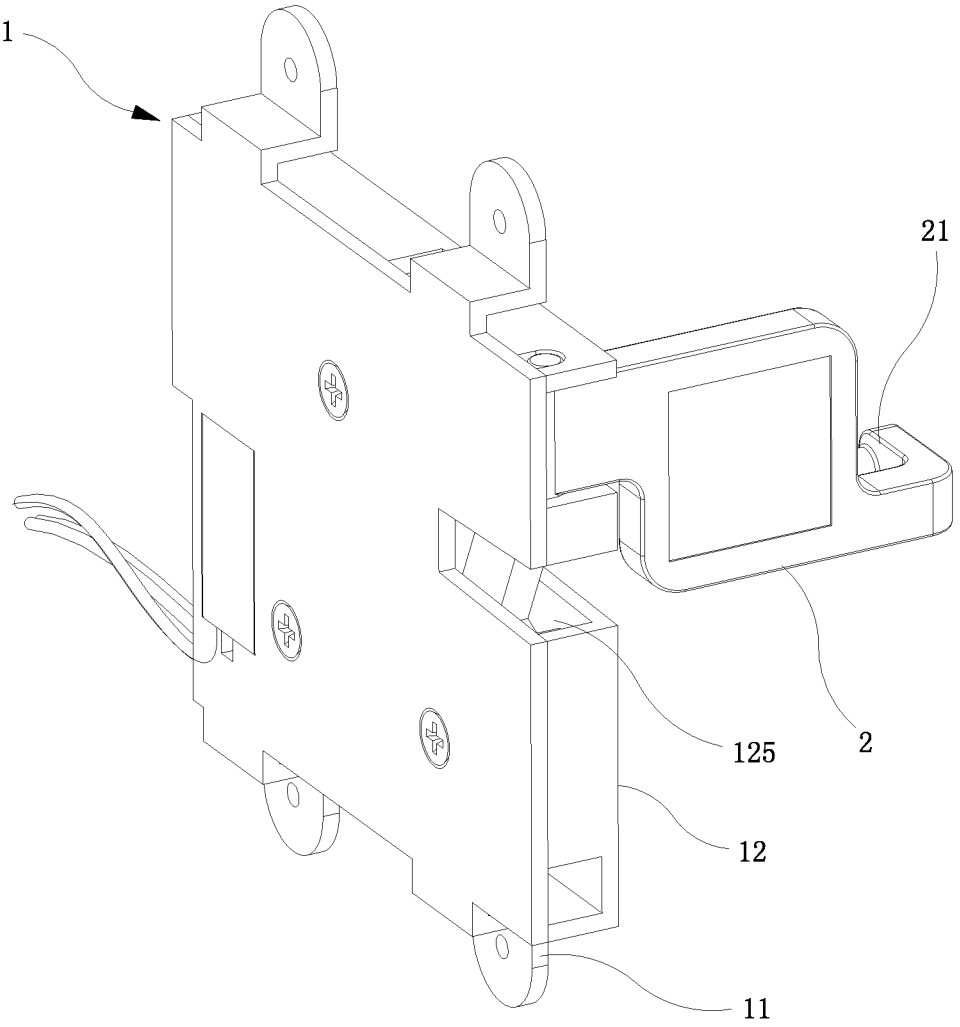
FIG. 2 is an assembled view of the present invention.
Figure 3:
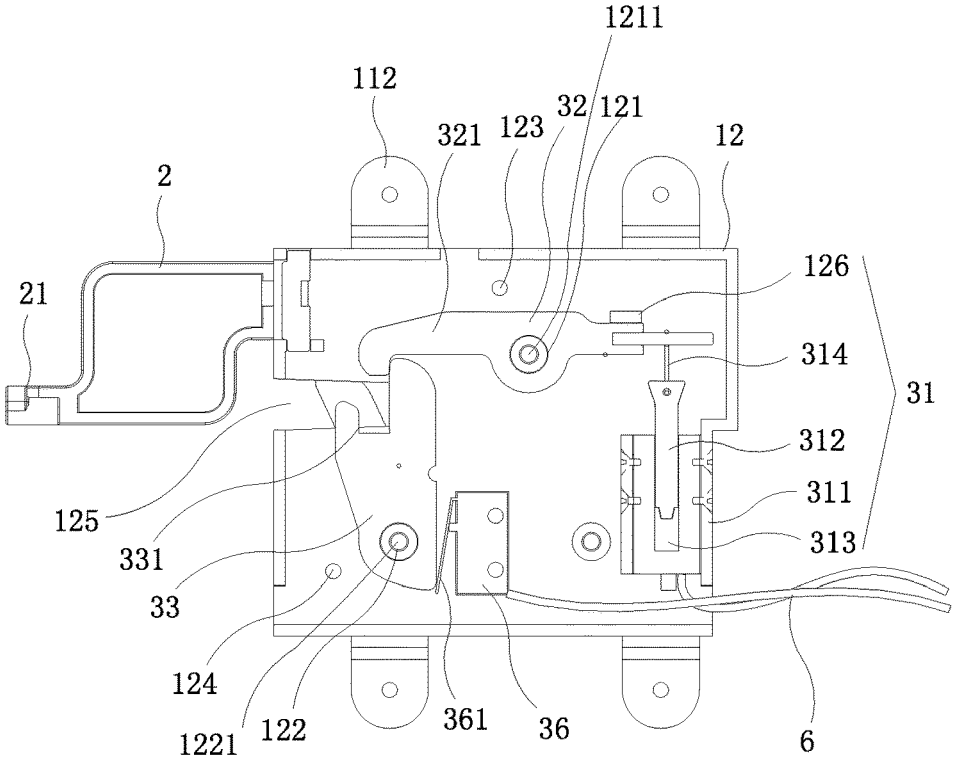
FIG. 3 is a sectional view of the present invention in a locked state.

When locking, referring to FIG. 3, the electronic actuator 31 will release the first rotating member 32 after receiving a signal or losing power. The first rotating member 32 driven by the first torsion spring 34 will be rotated to the position of the limiting block 126, and the user pushes the locking piece 2 to rotate about one end thereof, so that the second hook 21 enters the notch 125 of the casing 12 of the adjacent cabinet lock mounted on the frame 41 of the storage cabinet. The second hook 21 pushes the second rotating member 33 of another cabinet lock to rotate, and the second hook 21 is engaged in the catching portion 331 of the second rotating member 33 to be positioned therein. Since the first rotating member 32 is released by the electronic actuator 31, the catching portion 331 of the second rotating member 33 pushes the first hook 321 so that the first rotating member 32 overcomes the resistance of the first torsion spring 34 to rotate a small angle. The first hook 321 slides into the catching portion 331 by the first torsion spring 34 to be positioned therein, so that the locking piece 2 spans the cell between two frames 41 to achieve the locking operation. The second rotating member 33 is rotated by the second torsion spring 35, and its tail end pushes the elastic sheet 361 to trigger the electronic switch 36, and the electronic switch 36 sends the switch signal to the external control device.

Figure 4:
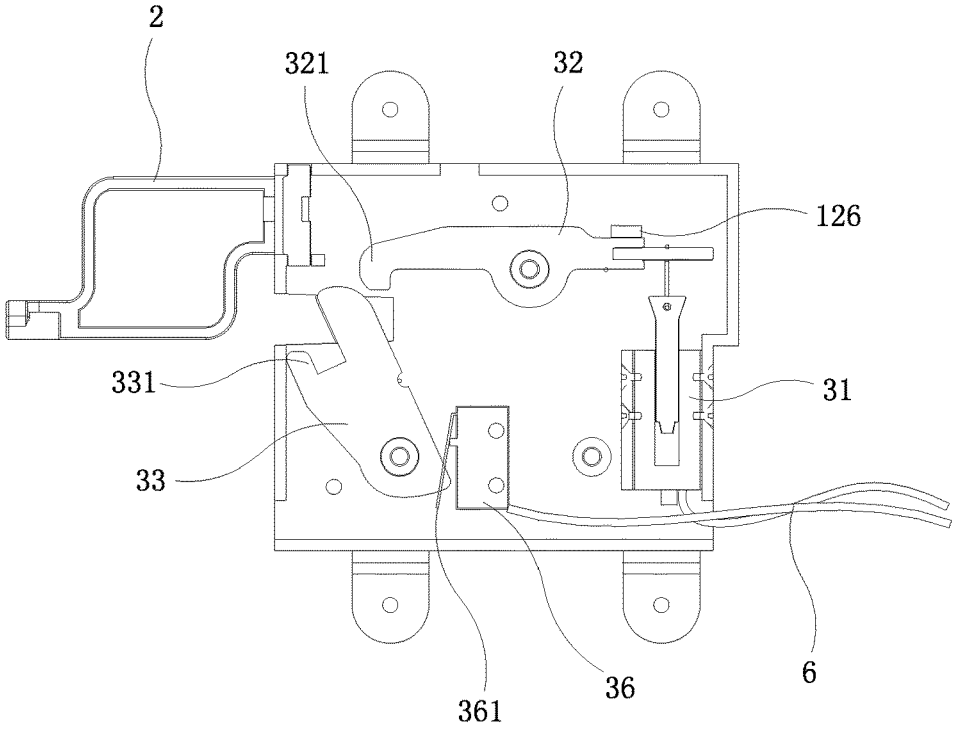
FIG. 4 is a sectional view of the present invention in an unlocked state.
Figure 5:
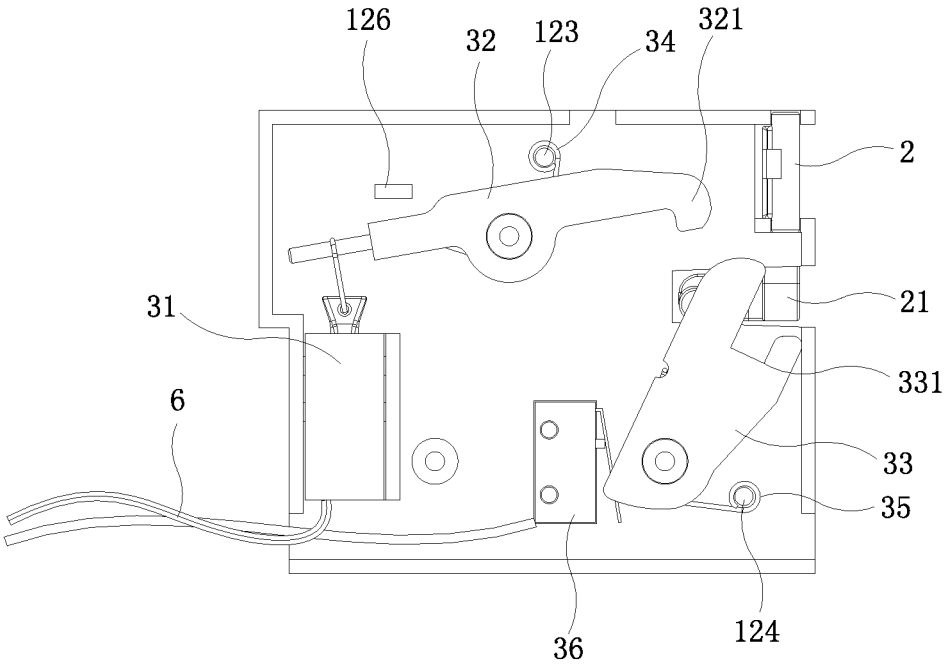
FIG. 5 and FIG. 6 are schematic views showing the unlocking process of the present invention (without the mounting plate)
Figure 6:
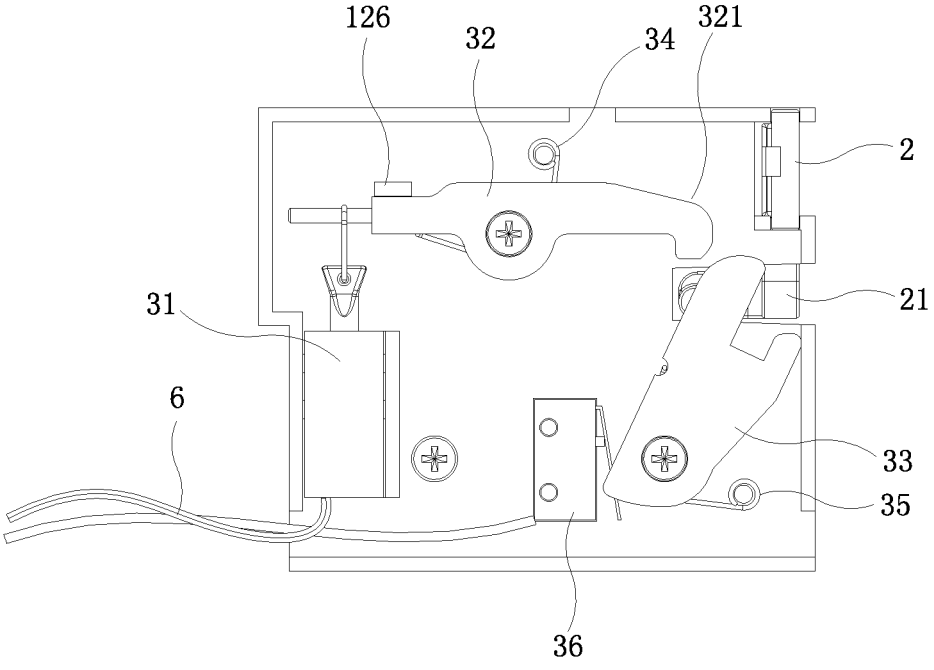

When unlocking, referring to FIGS. 4-6, the external control device sends a corresponding control signal to the electronic actuator 31 according to the switch signal. The electrically-driven sliding rod 312 of the electronic actuator 31 is moved downward to pull the first rotating member 32 to rotate about the first shaft 121, so that the catching portion 331 is disengaged from the first hook 321. The second rotating member 33 is rotated by the second torsion spring 35 to disengage the second hook 21 of the locking piece 2 from the catching portion 331 to achieve the unlocking operation. At this time, because the second rotating member 33 is rotated, its tail end leaves the elastic sheet 361, and the electronic switch 36 is retuned.

Figure 7:
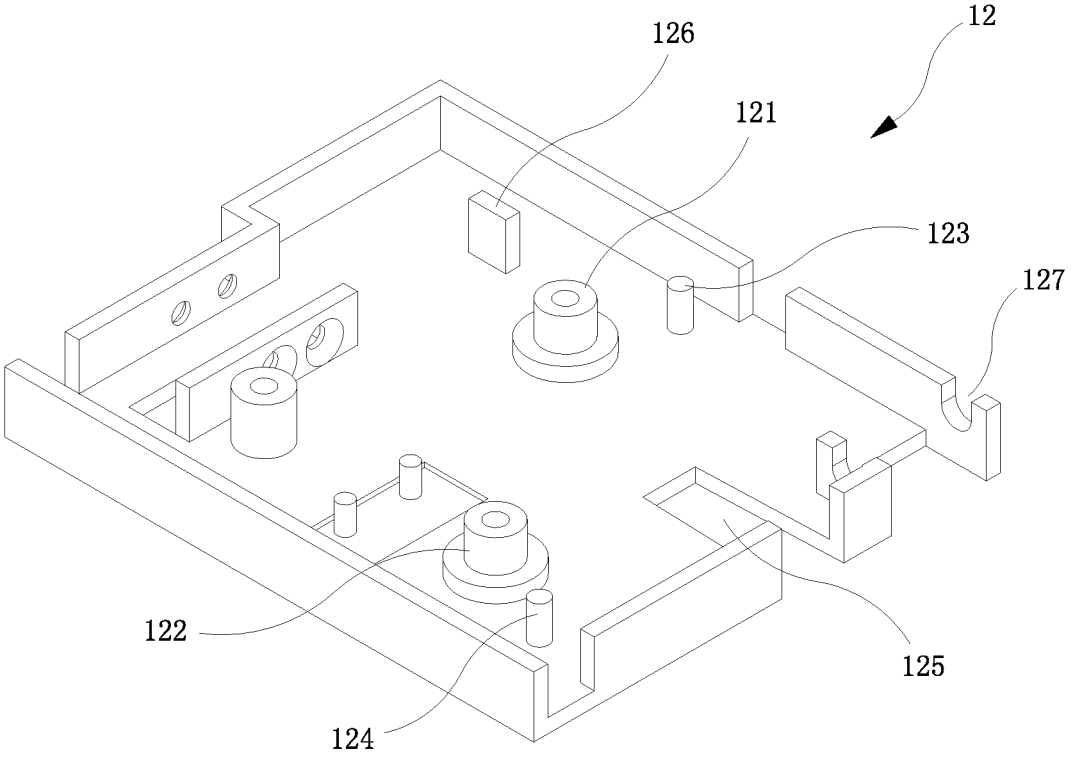
FIG. 7 is a schematic view of the casing of the present invention.
Figure 8:
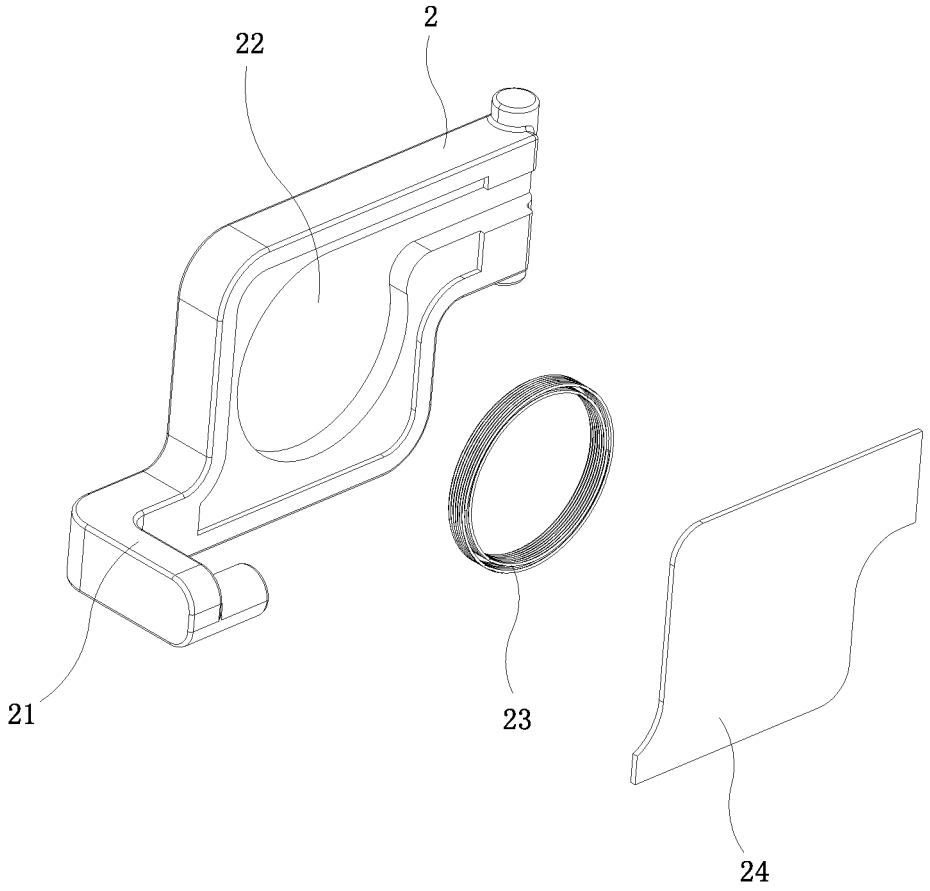
FIG. 8 is an exploded view of the locking piece of the present invention.

In a preferred embodiment, referring to FIG. 7, the casing 12 is provided with a limiting block 126 corresponding to the tail end of the first rotating member 32. The limiting block 126 limits the first rotating member 32 to a position where the first hook 321 can slide into the catching portion 331, so that the position of the first rotating member 32 is confined to be locked in place. Furthermore, in order to facilitate the sliding of the first hook 321 into the catching portion 331, the contact ends of the catching portion 331 and the first hook 321 are formed with curved surfaces.

In a preferred embodiment, for ease of installation, both the first shaft 121 and the second shaft 122 are formed with internal screw holes 1211 and 1221. The mounting plate 11 is also formed with screw holes 111 corresponding to the first shaft 121 and the second shaft 122. Furthermore, two fixing lugs 112 are formed on upper and lower sides of the mounting plate 11, respectively. A mounting hole 113 is formed in each fixing lug 112. Furthermore, one side of the casing 12 is formed with a shaft hole 127. The locking piece 2 is formed with a pivot shaft 25 corresponding to the shaft hole 127.

In a preferred embodiment, the locking piece 2 is formed with an accommodating hole 22. An induction coil 23 is installed in the accommodating hole 22. A sealing sheet 24 is attached to one side of the locking piece 2. The sealing sheet 24 is configured to seal the induction coil 23 in the accommodating hole 22. The induction coil 23 provides a way to recognize a card and transmits the control signal to the external control device through an external induction device, and then the external control device controls the electronic actuator 31. In the case of a network, the external control device can obtain control signals from other devices through networking to achieve wireless control unlocking.

The present invention is characterized by the realization of the interlocking function of locks, the overall structure is smaller than conventional similar locks, the operability and security are much higher than conventional locks, and it can realize local or network intelligent control.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A shared storage cabinet, comprising a cabinet body and a cabinet lock installed on the cabinet body, the cabinet body being divided into a plurality of cells by a frame thereof;

the cabinet lock comprising a lock body, a locking piece, and a locking and unlocking assembly; the lock body being laterally inserted into and fixed in the frame of the cabinet body, the locking and unlocking assembly being disposed in the lock body, one end of the locking piece being pivotally connected to one side of the lock body, another end of the locking piece being rotatable about the end thereof to achieve locking/unlocking in cooperation with the locking and unlocking assembly of another adjacent cabinet lock on the frame;

wherein the lock body includes a mounting plate and a casing, the locking and unlocking assembly includes an electronic actuator, a first rotating member, a second rotating member, a first torsion spring and a second torsion spring;

the mounting plate is laterally inserted into and fixed in the frame, the casing covers the mounting plate, an inner side of the casing is provided with a first shaft and a second shaft, the first rotating member is rotatably mounted on the casing through the first shaft, the first torsion spring is sleeved on the first shaft, one end of the first torsion spring is fixedly connected to a first fixing post, another end of the first torsion spring is fixedly connected to the first rotating member; the second rotating member is rotatably mounted on the casing through the second shaft, the second torsion spring is sleeved on the second shaft, one end of the second torsion spring is fixedly connected to a second fixing post, another end of the second torsion spring is fixedly connected to the second rotating member; the electronic actuator is movably mounted in the casing in an up-down manner and located below the first rotating member, an upper end of the electronic actuator is connected to a tail end of the first rotating member, a head end of the first rotating member is formed with a first hook, one end of the locking piece is pivotally connected to one side of the casing, the other end of the locking piece is formed with a second hook, a head end of the second rotating member is formed with a catching portion corresponding to the first hook and the second hook, the casing is formed with a notch corresponding to the second hook and disposed under the locking piece, the catching portion is located at the notch;

when locking, the locking piece is pushed by an external force to rotate about one end thereof, so that the second hook enters the notch of the casing of the another adjacent cabinet lock mounted on the frame, the second hook pushes the second rotating member of the another adjacent cabinet lock to rotate, inside the another adjacent cabinet lock, the second hook is engaged in the catching portion of the second rotating member to be positioned therein, the catching portion of the second rotating member pushes the first hook, and the first hook slides into the catching portion through the first torsion spring to be positioned therein;

inside the another adjacent cabinet lock, when unlocking, the electronic actuator is moved downward to pull the first rotating member to rotate about the first shaft, so that the catching portion is disengaged from the first hook, and the second rotating member is rotated by the second torsion spring to disengage the second hook of the locking piece from the catching portion.

2. The shared storage cabinet as claimed in claim 1, wherein the locking and unlocking assembly further includes an electronic switch, the electronic switch is mounted on the casing corresponding to a tail end of the second rotating member, the tail end of the second rotating member is in contact with an elastic sheet of the electronic switch, when unlocked, the second rotating member is rotated by the second torsion spring, and the second rotating member tail end pushes the elastic sheet to trigger the electronic switch.

3. The shared storage cabinet as claimed in claim 1, wherein the electronic actuator includes a seat and an electrically-driven sliding rod, the seat is fixed to the casing by screws, the seat has a groove therein, the electrically-driven sliding rod is slidably disposed in the groove in an up-down manner, and an upper end of the electrically-driven sliding rod is connected to the tail end of the first rotating member through a connecting ring.

4. The shared storage cabinet as claimed in claim 1, wherein the casing is provided with a limiting block corresponding to the tail end of the first rotating member, the limiting block limits the first rotating member to a position where the first hook can slide into the catching portion; said first fixing post and said second fixing post are provided on the casing, one end of the first torsion spring and one end of the second torsion spring are fixedly connected the first fixing post and the second fixing post of the casing, respectively; the first shaft and the second shaft are formed with internal screw holes, the mounting plate is formed with screw holes corresponding to the first shaft and the second shaft; two fixing lugs are formed on upper and lower sides of the mounting plate respectively, and a mounting hole is formed in each of the fixing lugs.

5. The shared storage cabinet as claimed in claim 1, wherein the locking piece is formed with an accommodating hole, an induction coil is installed in the accommodating hole, a sealing sheet is attached to one side of the locking piece, and the sealing sheet is configured to seal the induction coil in the accommodating hole.

6. The shared storage cabinet as claimed in claim 1, wherein the frame is formed with a receiving hole, and the mounting plate is laterally inserted into the receiving hole and fixed in the frame.

7. A cabinet lock for a shared storage cabinet, comprising a lock body, a locking piece, and a locking and unlocking assembly; the lock body being laterally inserted into and fixed in a frame of a cabinet body, the locking and unlocking assembly being disposed in the lock body, one end of the locking piece being pivotally connected to one side of the lock body, another end of the locking piece being rotatable about the end thereof to achieve locking/unlocking in cooperation with the locking and unlocking assembly of another adjacent cabinet lock on the frame;

wherein the lock body includes a mounting plate and a casing, the locking and unlocking assembly includes an electronic actuator, a first rotating member, a second rotating member, a first torsion spring and a second torsion spring;

the mounting plate is laterally inserted into and fixed in the frame, the casing covers the mounting plate, an inner side of the casing is provided with a first shaft and a second shaft, the first rotating member is rotatably mounted on the casing through the first shaft, the first torsion spring is sleeved on the first shaft, one end of the first torsion spring is fixedly connected to a first fixing post, another end of the first torsion spring is fixedly connected to the first rotating member; the second rotating member is rotatably mounted on the casing through the second shaft, the second torsion spring is sleeved on the second shaft, one end of the second torsion spring is fixedly connected to a second fixing post, another end of the second torsion spring is fixedly connected to the second rotating member; the electronic actuator is movably mounted in the casing in an up-down manner and located below the first rotating member, an upper end of the electronic actuator is connected to a tail end of the first rotating member, a head end of the first rotating member is formed with a first hook, one end of the locking piece is pivotally connected to one side of the casing, the other end of the locking piece is formed with a second hook, a head end of the second rotating member is formed with a catching portion corresponding to the first hook and the second hook, the casing is formed with a notch corresponding to the second hook and disposed under the locking piece, the catching portion is located at the notch;

when locking, the locking piece is pushed by an external force to rotate about one end thereof, so that the second hook enters the notch of the casing of the another adjacent cabinet lock mounted on the frame, the second hook pushes the second rotating member of the another adjacent cabinet lock to rotate, inside the another adjacent cabinet lock, the second hook is engaged in the catching portion of the second rotating member to be positioned therein, the catching portion of the second rotating member pushes the first hook, and the first hook slides into the catching portion through the first torsion spring to be positioned therein;

inside the another adjacent cabinet lock, when unlocking, the electronic actuator is moved downward to pull the first rotating member to rotate about the first shaft, so that the catching portion is disengaged from the first hook, and the second rotating member is rotated by the second torsion spring to disengage the second hook of the locking piece from the catching portion.

8. The cabinet lock as claimed in claim 7, wherein the locking and unlocking assembly further includes an electronic switch, the electronic switch is mounted on the casing corresponding to a tail end of the second rotating member, the tail end of the second rotating member is in contact with an elastic sheet of the electronic switch, when unlocked, the second rotating member is rotated by the second torsion spring, and the second rotating member tail end pushes the elastic sheet to trigger the electronic switch.

* * * * *